US011293622B2

(12) United States Patent
Bu et al.

(10) Patent No.: US 11,293,622 B2
(45) Date of Patent: Apr. 5, 2022

(54) CYLINDRICAL LIGHTING FIXTURE

(71) Applicants: OPPLE LIGHTING CO., LTD., Shanghai (CN); SUZHOU OPPLE LIGHTING CO., LTD., Suzhou (CN)

(72) Inventors: Chenxi Bu, Shanghai (CN); Yisheng Xiao, Shanghai (CN); Xianglan Li, Shanghai (CN); Yinfei Yu, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/336,219

(22) Filed: Jun. 1, 2021

(65) Prior Publication Data

US 2021/0285620 A1 Sep. 16, 2021

Related U.S. Application Data

(63) Continuation of application No. PCT/CN2019/123100, filed on Dec. 4, 2019.

(30) Foreign Application Priority Data

Dec. 4, 2018 (CN) ..... 201822023168.0

(51) Int. Cl.
*F21V 17/16* (2006.01)
*F21V 23/06* (2006.01)
(Continued)

(52) U.S. Cl.
CPC ..... *F21V 5/04* (2013.01); *F21V 17/164* (2013.01); *F21V 23/06* (2013.01); *F21Y 2107/40* (2016.08)

(58) Field of Classification Search
CPC ..... F21V 23/06; F21V 17/164; F21V 5/04
See application file for complete search history.

(56) References Cited

U.S. PATENT DOCUMENTS 8,330,342 B2 * 12/2012 Bhairi ..... F21V 7/0091 313/116
9,228,727 B2 * 1/2016 May ..... F21V 5/04
(Continued)

FOREIGN PATENT DOCUMENTS

CN 101963292 A 2/2011
CN 202546432 U 11/2012
(Continued)

OTHER PUBLICATIONS

International Search Report of PCT Application No. PCT/CN2019/123100 dated Mar. 9, 2020 with English translation, (6p).
(Continued)

*Primary Examiner* — Arman B Fallahkhair
(74) *Attorney, Agent, or Firm* — Arch & Lake LLP

(57) ABSTRACT

Examples of the present disclosure disclose a cylindrical lighting fixture, which includes a body, a plurality of light source modules and a plurality of diverging lenses. The body has an axis, the body has two ends, the two ends are penetrated by the axis, the plurality of light source modules are arranged on the body around the axis, the light source module includes a light source plate and a light-emitting unit, the light-emitting unit is arranged at a side of the light source plate away from the body, and each diverging lens covers one of the light source modules; and the diverging lens includes an inner surface facing the axis and an outer surface away from the axis, the inner surface is recessed to form a cavity, the cavity extends in the same direction as the axis, and the light-emitting unit is arranged in the cavity.

20 Claims, 4 Drawing Sheets

(51) Int. Cl.
*F21V 5/04* (2006.01)
*F21Y 107/40* (2016.01)

(56) References Cited

U.S. PATENT DOCUMENTS

| | | | | |
|---|---|---|---|---|
| 9,285,084 | B2 * | 3/2016 | Amrine, Jr. | F21V 17/04 |
| 9,285,088 | B2 * | 3/2016 | Rolfes | F21V 23/003 |
| 9,739,426 | B2 * | 8/2017 | Hoechtl | F21K 9/61 |
| 10,883,669 | B2 * | 1/2021 | Brown | F21V 5/04 |
| 2010/0254138 | A1 | 10/2010 | Chen et al. | |
| 2011/0019421 | A1 * | 1/2011 | Lai | F21K 9/27 362/249.06 |
| 2011/0156584 | A1 * | 6/2011 | Kim | F21K 9/232 315/32 |
| 2014/0313731 | A1 * | 10/2014 | Kwak | F21V 17/104 362/294 |

FOREIGN PATENT DOCUMENTS

| | | | |
|---|---|---|---|
| CN | 106524079 | A | 3/2017 |
| CN | 208090482 | U | 11/2018 |
| CN | 209165146 | U | 7/2019 |
| JP | 2011060719 | A | 3/2011 |
| TW | 364168 | U | 9/2009 |
| WO | 2017041624 | A1 | 3/2017 |

OTHER PUBLICATIONS

Chinese First Notification of Rectification issued in CN2018220231680, dated May 23, 2019, 1 page.
Chinese First Notification of Rectification issued in CN2019215088085, dated Mar. 6, 2020, 1 page.
European Communication issued in EP19892180.1, dated Jun. 16, 2021, 1 page.
European Communication issued in EP19892180.1, dated Aug. 11, 2021, 2 pages.

* cited by examiner

CYLINDRICAL LIGHTING FIXTURE

CROSS-REFERENCE TO RELATED APPLICATIONS

This application is based upon and claims the priority of PCT patent application No. PCT/CN2019/123100 filed on Dec. 4, 2019 which claims priority to the Chinese patent application No. 201822023168.0 filed on Dec. 4, 2018 and the Chinese patent application No. 201921508808.5 filed on Sep. 9, 2019, the entire content of both of which is hereby incorporated by reference herein for all purposes.

TECHNICAL FIELD

The present application relates to the technical field of illumination equipment, and in particular, to a cylindrical lighting fixture.

BACKGROUND

With increasingly high requirements of people on lighting fixtures, the types of lighting fixtures also changed fast, which are no longer limited to pendant lighting fixtures or spotlights. Because of the advantages, such as large illumination area, space saving and the like, the cylindrical lighting fixture has become a popular choice gradually.

SUMMARY

The present application provide a cylindrical lighting fixture and a method of manufacturing a cylindrical lighting fixture.

The present disclosure provides a cylindrical lighting fixture. The cylindrical lighting fixture may include a body, a plurality of light source modules and a plurality of diverging lenses. The body may include an axis, the body may include two ends, the two ends may be penetrated by the axis, the plurality of light source modules may be arranged on the body around the axis, each of the light source modules may include a light source plate and a light-emitting unit, the light-emitting unit may be arranged at a side of the light source plate away from the body, each diverging lens may cover one of the light source modules, and the diverging lens may include an inner surface facing the axis and an outer surface away from the axis, the inner surface may be recessed in a direction away from the body to form a cavity, the cavity may extend in a same direction as the axis, and the light-emitting unit may be arranged in the cavity.

The present disclosure also provides cylindrical lighting fixture. The cylindrical lighting fixture may include a body. The body may include two ends and an axis, the two ends may be penetrated by the axis, the body may be provided with a plurality of lens slots, the body may be made of metal, the plurality of lens slots may be arranged around the axis, and the lens slots may extend in a same direction as the axis; and adjoined sides of two adjacent lens slots may be integrated into an adjoined portion, and the adjoined portion may include an outer side surface away from the axis The present disclosure may further include a method of manufacturing a cylindrical lighting fixture, The method may include providing a body, a plurality of light source modules and a plurality of diverging lenses; providing an axis and two ends to the body; penetrating the two ends by the axis; arranging the plurality of light source modules on the body around the axis; providing a light source plate and a light-emitting unit to each of the light source modules; arranging the light-emitting unit at a side of the light source plate away from the body; covering one of the light source modules by each diverging lens; providing an inner surface facing the axis and an outer surface away from the axis to the diverging lens; recessing the inner surface in a direction away from the body to form a cavity; extending the cavity in a same direction as the axis; and arranging the light-emitting unit in the cavity.

It is to be understood that both the foregoing general description and the following detailed description are exemplary and explanatory only and are not restrictive of the present disclosure.

BRIEF DESCRIPTION OF THE DRAWINGS

The accompanying drawings described here are used for further understanding of the present application and constitute a part of the present application. Schematic examples of the present disclosure and the description thereof are used to explain the present disclosure, and do not constitute an improper limitation to the present disclosure. In the drawings.

DETAILED DESCRIPTION

Figure 1:
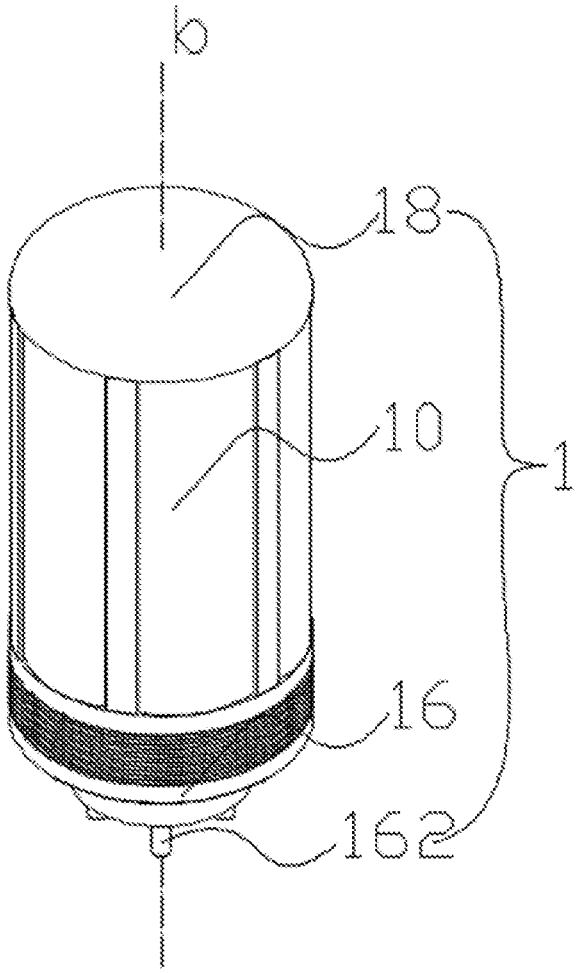
FIG. 1 is a front view of a cylindrical lighting fixture disclosed by an example of the present disclosure.

The examples will be described in a clearly and fully understandable way in connection with the drawings related to the examples of the disclosure. Apparently, the described examples are just a portion but not all of the examples of the disclosure. Based on the described examples herein, those skilled in the art can obtain other example (s), without any inventive work, which should be within the scope of the disclosure.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Description of numerals in the drawings may include:

1—cylindrical lighting fixture; 10—lighting fixture body; 12—light source module; 14—diverging lens; 16—base; 18—top cover; 102—light source plate slot; 104—lens slot; 106—shading portion; 108—light outgoing notch; 120—light-emitting unit; 122—light source plate; 140—outer surface; 142—inner surface; 144—cavity; 146—side surface; 162—electric plug; 182—hook; 1040—side wall; 1042—second clamping portion; 1044—adjoined portion; 1046—outer side surface; 1460—first clamping portion.

Some cylindrical lighting fixtures utilize directly a plurality of light sources to emit light. In order to realize homogeneous light, a translucent diffusion lamp shade is usually used, which reduces the light emitting amount, and also affects the appearance attractiveness. If the lamp shade made of a transparent material is used, a dark area may appear at a joint of two adjacent light sources, affecting the overall luminous effect.

An example of the present disclosure discloses a cylindrical lighting fixture 1, as shown in FIG. 1. The cylindrical lighting fixture 1 includes a body 10. The body 10 has an axis b. The body 10 has two ends, and the two ends are penetrated by the axis b. The cylindrical lighting fixture 1 may include a base 16 for placing the body 10, and the body 10 is disposed on the base 16. As shown in FIG. 1, to improve the heat dissipation performance, the base 16 and a top cover 18 may be made of metal respectively or entirely.

Figure 6:
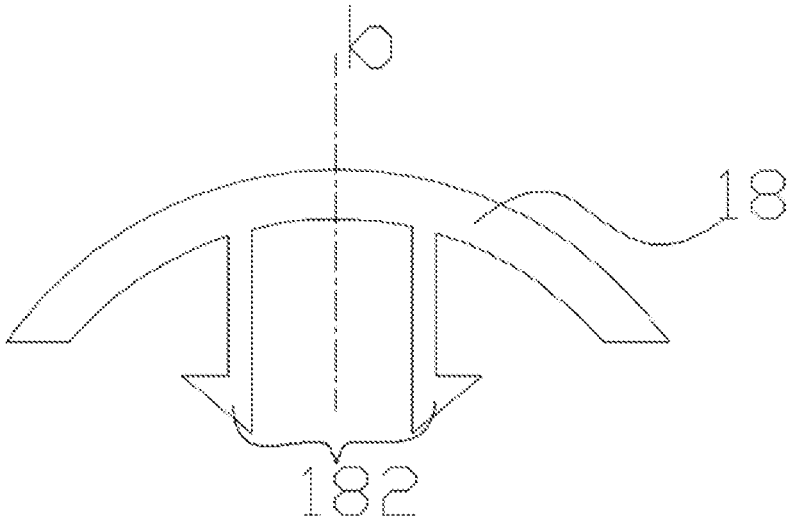
FIG. 6 is a cross-sectional view of a top cover along an axis of the top cover disclosed by an example of the present disclosure.

To improve the sealability of the cylindrical lighting fixture 1, the cylindrical lighting fixture 1 may include the top cover 18. The top cover 18 covers one of the two ends of the body 10. In an example, the top cover 18 may be clamped at one end of the body 10 through a mortise-tenon structure. FIG. 6 shows a cross-sectional view along the axis b of the top cover 18 with the mortise-tenon structure. The top cover 18 may be clamped at the upper end of the body 10 through hooks 182. The covered end of the body 10 has a clamping structure. The clamping structure is provided with a bayonet matched with the hooks 182. The clamping structure and the bayonet may be in various forms, which are not listed here. The top cover 18 may also cover one end of the body 10 in other forms, such as a dovetail joint, which is not repeated here.

Figure 2:
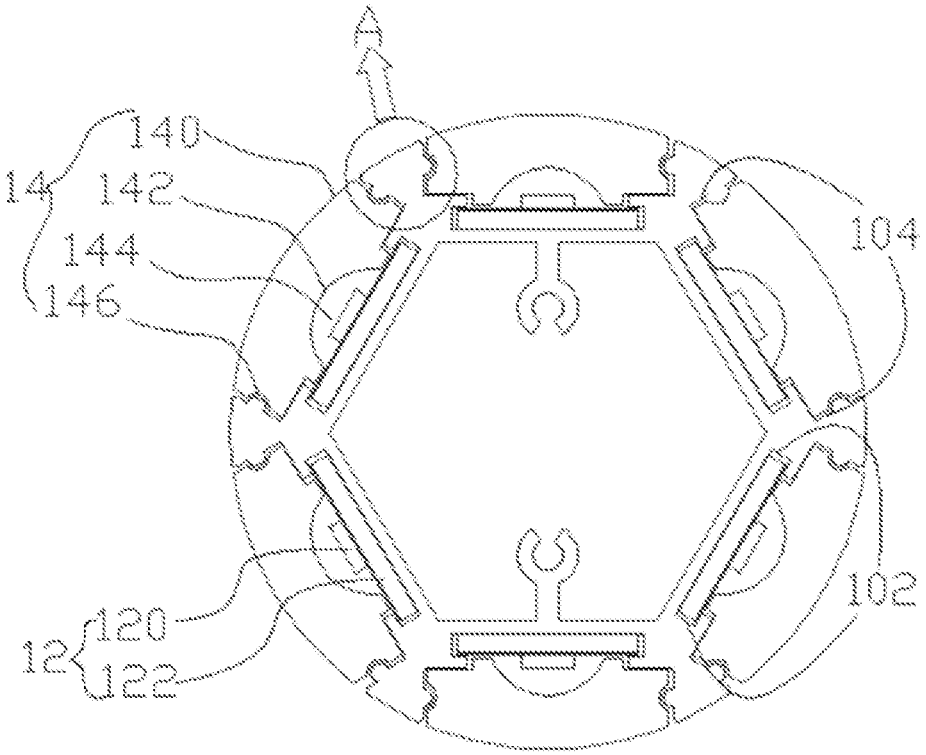
FIG. 2 is a cross-sectional view perpendicular to an axis of the cylindrical lighting fixture shown in FIG. 1.

The cylindrical lighting fixture 1 further includes a plurality of light source modules 12 and diverging lens 14 matched with the light source modules 12, as shown in FIG. 2. The plurality of light source modules 12 are arranged on the body 10 around the axis b. The light source module 12 includes a light-emitting unit 120 and a light source plate 122. The light-emitting unit 120 is arranged at a side of the light source plate 122 away from the body 10. Each diverging lens 14 covers one light source module 12. A hyperboloid lens 14 includes an outer surface 140 away from the axis of the body 10 and an inner surface 142 facing the axis b. The inner surface 142 is recessed in a direction away from the body 10 to form a cavity 144. The cavity 144 extends in the same direction as the axis b. The light-emitting unit 120 is arranged in the cavity 144.

The present example adopts a plurality of diverging lenses cooperated with each other, which are used to diverge light emitted from the light source plate corresponding to the diverging lens. Therefore, emergent rays diverged by the adjacent diverging lenses may interfere with each other, so that the rays may be emitted to the periphery at 360°, thereby realizing the technical effect of 360° light emitting and no light emitting dark area.

The diverging lens described in the present example refers to the lens with higher divergence degree of emergent rays than that of the incident rays, and it may be a hyperboloid lens, such as a concavo-convex lens, and it may also be a plano-concave lens, which is not repeated here.

In the present example, the cross-sections, perpendicular to the axis b, of the light source modules 12 and diverging lenses 14 may be designed as axisymmetric structures, so that an outgoing light path is also an axisymmetric structure, thereby improving the light emitting homogeneity of the cylindrical lighting fixture 1.

In the present example, the body 10 may be provided with a plurality of light source plate slots 102. The plurality of light source plate slots 102 are arranged around the axis b and extend in the same direction as the axis b. The light source plates 122 are inserted in the light source plate slots 102, respectively. The light source plates are fixed on the body in an inserting manner, so that, on the premise of guaranteeing the structural stability, the disassembly and maintenance are facilitated.

To improve the heat dissipation efficiency and the structural strength of the body, the body 10 may be made of a metal material. Furthermore, the light source plate slots 102 may be designed as U-shaped slots with an opening direction away from the axis b, so that the area of a contact portion between the light source plates and the body 10 is increased, and the heat dissipation efficiency may be improved.

In the present example, the body 10 may also be provided with a plurality of lens slots 104. The plurality of lens slots 104 are arranged around the axis b and extend in the same direction as the axis b. The diverging lenses 14 are inserted in the lens slots 104. The diverging lenses 14 are fixed on the body 10 in an inserting manner, so that, on the premise of guaranteeing the structural stability, the disassembly and maintenance are facilitated.

Figure 5:
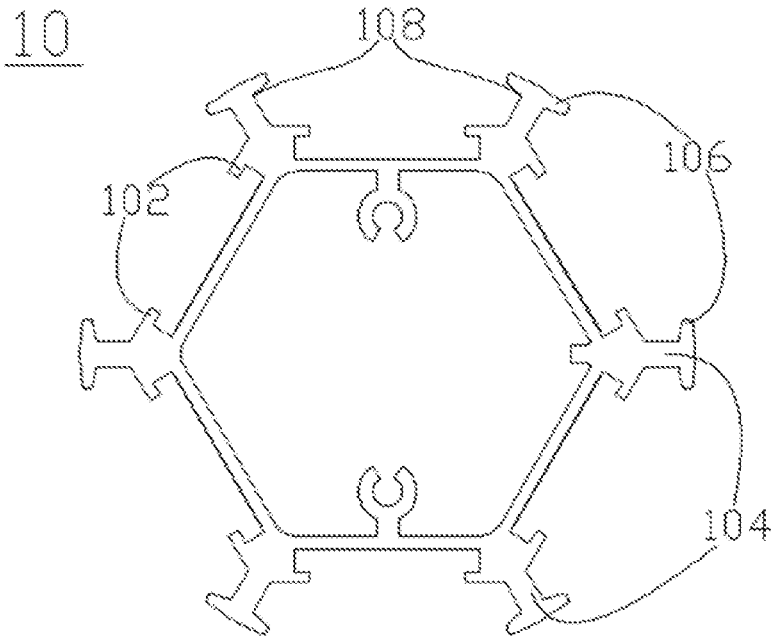
FIG. 5 is a cross-sectional view of lighting fixture body perpendicular to an axis of the lighting fixture body disclosed by an example of the present disclosure.

When the diverging lenses 14 are fixed in an inserting manner, to make the rays in the light emitting area all emergent from the outer surface 140, to avoid the interference of the rays that are emergent from other positions and to further realize good illumination effect, the body 10 is provided with a plurality of shading portions 106. As shown in FIG. 5, one side of each lens slot 104 away from the axis b has a light outgoing notch 108. Two sides of each light outgoing notch 108 have respectively the shading portion 106. Each shading portion 106 extends from the light outgoing notch 108 to cover the edge of the outer surface 140. Because any other areas where the light may be emitted, except for the outer surface 140, are shaded by the shading portions 106 and the lens slots 104, a technical effect that all emergent rays are emergent from a restricted region of the outer surface, and there is no interference of random light emergent from other positions is achieved.

The shading portions 106 may be integrated with the lens slots 104. At the same time, the shading portions 106 prevent the separation of the diverging lenses 14 in the direction away from the axis b, thereby further fixing the diverging lenses.

Figure 4:
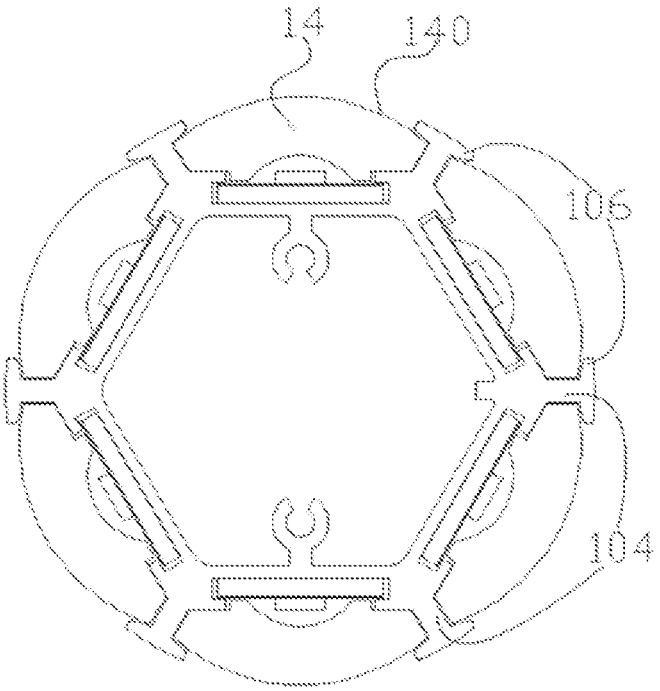
FIG. 4 is a cross-sectional view of a lighting fixture body perpendicular to the axis of the cylindrical lighting fixture with shading portions disclosed by an example of the present disclosure.

As shown in FIG. 4, the two shading portions 106 disposed at adjoined sides of two adjacent lens slots 104 may be integrated, thereby increasing the heat dissipation area, and improving the heat dissipation efficiency.

Figure 3:
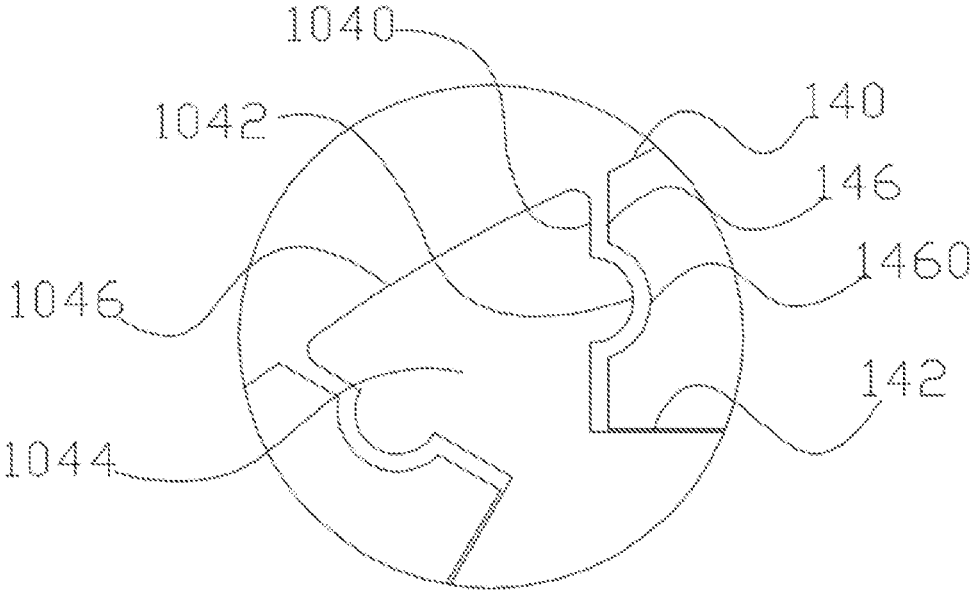
FIG. 3 is a partial enlarged view of a lens slot and a diverging lens shown in an area A in FIG. 2.

In an example, each diverging lens 14 includes a pair of opposite side surfaces 146 extending in the same direction as the axis b. The inner surface 142 is connected with the outer surface 140 through the side surfaces 146. To enhance the fixation between the diverging lenses 14 and the body 10, the side surfaces 146 are provided with a first clamping portion 1460, respectively, as shown in FIG. 3. FIG. 3 is an enlarged view of an area A in FIG. 2. The lens slot 104 includes a pair of side walls 1040 extending in the same direction as the axis b. Each of the side walls 1040 is provided with a second clamping portion 1042 matched with the first clamping portion 1460. The first clamping portions 1460 and the second clamping portions 1042 are cooperated to fix the diverging lenses on the body 10. In this way, the separation of the diverging lenses 14 in the direction away from the axis b is avoided, and more choices for the fixation of the diverging lenses are provided. Only the example in which the fixation is achieved by the shape matching of one first clamping portion and one second clamping portion is described here, in actual application, any number of first clamping portions and second clamping portions may be used, which is not repeated here.

To enhance the mechanical strength of the body, as shown in FIG. 3, the adjoined sides of two adjacent lens slots 104 may be integrated to form an integral adjoined portion 1044. An outer side surface 1046 of the adjoined portion 1044 away from the axis b is smoothly transitioned to the outer surfaces 140 of the adjacent two diverging lenses, as shown in FIG. 4. By the smooth transition, the adjacent edges of the outer side surface 1046 and the outer surface 140 may be flush with each other. Where the gaps formed by the adjoined portions are neglected, all of the outer side surfaces 1046 and the outer surfaces 140 can be spliced into a regular outer contour, so that an outer contour line of a cross-section of the body 1 perpendicular to the axis b forms a regular shape, such as a circle, oval, rounded quadrilateral, rounded hexagon, rounded octagon and the like. FIG. 2 shows the case where the outer contour line of the cross-section of the body 1 perpendicular to the axis b is circular. Other case where the outer contour line is in other shapes is not repeated here.

To enhance the use convenience of the cylindrical lighting fixture, as shown in FIG. 1, an electric plug 162 may be provided on the base 16. The electric plug 162 is configured to power the light source modules 12. The electric plug 162 may be plugged in a socket for taking electric power. The shape of the electric plug 162 may be designed as E14, E27, G10 and the like. FIG. 1 shows the electric plug 162 in a form of G10.

The examples of the present disclosure have the beneficial effects: the present disclosure adopts a plurality of diverging lenses to diverge rays emergent from the light source plates corresponding to the lenses. Therefore, the emergent rays diverged by the two adjacent diverging lenses may interfere with each other, so as to eliminate a dark area formed originally due to no light source at the joint of the light source plates, thereby realizing the light emission at 360°, no dark area and good luminous effect.

In conclusion, the cylindrical lighting fixture provided by the examples of the present disclosure can achieve the technical effect of no light emitting dark area.

The above examples of the present disclosure focus on differences among the various examples. As long as different optimization features among the various examples are not contradictory, the examples can be combined to form a better example, which is not repeated here for brevity.

The present disclosure provides a cylindrical lighting fixture, which may include a body, a plurality of light source modules and a plurality of diverging lenses, the body having an axis, the body having two ends, the two ends being penetrated by the axis, the plurality of light source modules being arranged on the body around the axis, each of the light source modules including a light source plate and a light-emitting unit, the light-emitting unit being arranged at a side of the light source plate away from the body, each diverging lens covering one of the light source modules, the diverging lens includes an inner surface facing the axis and an outer surface away from the axis, the inner surface is recessed in a direction away from the body to form a cavity, the cavity extends in a same direction as the axis, and the light-emitting unit is arranged in the cavity.

In an implementation, cross-sections of the light source modules and the diverging lenses perpendicular to the axis are axisymmetric structures.

In an implementation, the light source plate slots are U-shaped slots, directions of openings of the U-shaped slots are away from the axis.

In an implementation, the body is provided with a plurality of lens slots, the plurality of lens slots are arranged around the axis, the lens slots extend in a same direction as the axis, and the diverging lenses are inserted in the lens slots, respectively.

In an implementation, the body is provided with a plurality of shading portions, a side of each lens slot away from the axis has a light outgoing notch, two sides of each light outgoing notch have the shading portions, respectively, and the shading portions respectively extend from each light outgoing notch to cover the edge of the outer surface.

In an implementation, two of the shading portions arranged at adjoined sides of two adjacent lens slots are integrated.

In an implementation, the shading portions and the lens slots are integrated, and the shading portions prevent the separation of the diverging lenses in a direction away from the axis.

In an implementation, each of the diverging lenses includes a pair of opposite side surfaces extending in a same direction as the axis, the inner surface is connected with the outer surface through the side surfaces, the side surfaces are provided with at least one first clamping portion, each of the lens slots includes a pair of opposite side walls extending in a same direction as the axis, the side walls are provided with a second clamping portion matched with the first clamping portion, and the first clamping portion and the second clamping portion are cooperated to prevent the separation of the diverging lenses away from the axis.

In an implementation, the adjoined sides of two adjacent lens slots are integrated into an adjoined portion, the adjoined portion includes an outer side surface away from the axis, and the outer side surface is transitioned smoothly to the adjacent outer surface.

In an implementation, an outer contour of a cross-section of the cylindrical lighting fixture perpendicular to the axis is circular.

In an implementation, the cylindrical lighting fixture further comprises a base, and the body is arranged on the base.

In an implementation, the body and/or the base are/is made of metal.

In an implementation, the base is provided with an electric plug, and the electric plug is configured to be inserted in a socket to powers the light source modules.

In an implementation, the cylindrical lighting fixture further comprises a top cover, and the top cover covers one of the two ends.

The present disclosure may provide a method of manufacturing a cylindrical lighting fixture. The method may include providing a body, a plurality of light source modules and a plurality of diverging lenses; providing an axis and two ends to the body; penetrating the two ends by the axis; arranging the plurality of light source modules on the body around the axis; providing a light source plate and a light-emitting unit to each of the light source modules; arranging the light-emitting unit at a side of the light source plate away from the body; covering one of the light source modules by each diverging lens; providing an inner surface facing the axis and an outer surface away from the axis to the diverging lens; recessing the inner surface in a direction away from the body to form a cavity; extending the cavity in a same direction as the axis; and arranging the light-emitting unit in the cavity.

The method may also include providing the body with a plurality of light source plate slots, arranging the plurality of light source plate slots around the axis, extending the light source plate slots in a same direction as the axis, and inserting the light source plates in the light source plate slots.

The method may further include providing the body with a plurality of lens slots, arranging the plurality of lens slots around the axis, extending the lens slots in a same direction as the axis, and inserting the diverging lenses into the lens slots.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The described above are only examples of the present disclosure, and are not intended to limit the present disclosure. For those skilled in the art, the present disclosure may have various modifications and changes.

What is claimed is:

1. A cylindrical lighting fixture, comprising: a body, a plurality of light source modules and a plurality of diverging lenses, wherein:

the body comprises an axis, the body comprises two ends, the two ends are penetrated by the axis, the plurality of light source modules are arranged on the body around the axis, each of the light source modules comprises a light source plate and a light-emitting unit, the light-emitting unit is arranged at a side of the light source plate away from the body, each diverging lens covers one of the light source modules, the diverging lens comprises an inner surface facing the axis and an outer surface away from the axis, the inner surface is recessed in a direction away from the body to form a cavity, the cavity extends in a same direction as the axis, and the light-emitting unit is arranged in the cavity, the body comprises a plurality of lens slots, and the diverging lenses are inserted into the plurality of lens slots, and a side of each lens slot away from the axis comprises a light outgoing notch, two sides of each light outgoing notch comprise shading portions, and the shading portions respectively extend from each light outgoing notch to cover the edge of the outer surface.

2. The cylindrical lighting fixture according to claim 1, wherein the plurality of lens slots are arranged around the axis, and the lens slots extend in a same direction as the axis.

3. The cylindrical lighting fixture according to claim 2, wherein each of the diverging lenses comprises a pair of opposite side surfaces extending in a same direction as the axis, the inner surface is connected with the outer surface through the side surfaces, the side surfaces are provided with at least one first clamping portion, each of the lens slots comprises a pair of opposite side walls extending in a same direction as the axis, the side walls are provided with a second clamping portion matched with the first clamping portion, and the first clamping portion and the second clamping portion are cooperated to prevent the separation of the diverging lenses away from the axis.

4. The cylindrical lighting fixture according to claim 3, wherein the adjoined sides of two adjacent lens slots are integrated into an adjoined portion, the adjoined portion comprises an outer side surface away from the axis, and the outer side surface is transitioned to the adjacent outer surface.

5. The cylindrical lighting fixture according to claim 4, wherein an outer contour of a cross-section of the cylindrical lighting fixture perpendicular to the axis is circular.

6. The cylindrical lighting fixture according to claim 2, wherein each diverging lenses covers only one light source module.

7. The cylindrical lighting fixture according to claim 6, wherein two of the shading portions arranged at adjoined sides of two adjacent lens slots are integrated.

8. The cylindrical lighting fixture according to claim 6, wherein the shading portions and the lens slots are integrated, and the shading portions prevent the separation of the diverging lenses in a direction away from the axis.

9. The cylindrical lighting fixture according to claim 1, wherein the cylindrical lighting fixture further comprises a base, and the body is arranged on the base.

10. The cylindrical lighting fixture according to claim 9, wherein the body or the base is made of metal.

11. The cylindrical lighting fixture according to claim 9, wherein the base is provided with an electric plug, and the electric plug powers the light source modules.

12. The cylindrical lighting fixture according to claim 1, wherein the body is provided with a plurality of light source plate slots, the plurality of light source plate slots are arranged around the axis, the light source plate slots extend in a same direction as the axis, and the light source plates are inserted in the light source plate slots.

13. The cylindrical lighting fixture according to claim 12, wherein the light source plate slots are U-shaped slots, and an opening direction of each of the U-shaped slots is away from the axis.

14. The cylindrical lighting fixture according to claim 1, wherein cross-sections of the light source modules and the diverging lenses perpendicular to the axis are axisymmetric structures.

15. The cylindrical lighting fixture according to claim 1, wherein the diverging lenses are hyperboloid diverging lenses.

16. The cylindrical lighting fixture according to claim 1, wherein the cylindrical lighting fixture further comprises a top cover, and the top cover covers one of the two ends.

17. A method of manufacturing a cylindrical lighting fixture comprises: providing a body, a plurality of light source modules and a plurality of diverging lenses; providing an axis and two ends to the body; aligning the axis along the two ends; arranging the plurality of light source modules on the body around the axis; providing a light source plate and a light-emitting unit to each of the light source modules; arranging the light-emitting unit at a side of the light source plate away from the body; covering each of the light source modules by one diverging lens; providing an inner surface facing the axis and an outer surface away from the axis to the diverging lens; recessing the inner surface in a direction away from the body to form a cavity; extending the cavity in a same direction as the axis; arranging the light-emitting unit in the cavity, providing the body with a plurality of lens slots; inserting the plurality of diverging lenses into the plurality of lens slots; providing a light outgoing notch on a side of each lens slot away from the axis; providing shading portions on two sides of each light outgoing notch; and respectively extending the shade portions from each light outgoing notch to cover the edge of the outer surface.

18. The method of claim 17, further comprising:

providing the body with a plurality of light source plate slots, arranging the plurality of light source plate slots around the axis, extending the light source plate slots in a same direction as the axis, and inserting the light source plates in the light source plate slots.

19. The method of claim 17, further comprising:

arranging the plurality of lens slots around the axis, and extending the lens slots in a same direction as the axis.

20. A cylindrical lighting fixture, comprising a body, wherein the body comprises two ends and an axis, the two ends are penetrated by the axis, plurality of light source modules are arranged on the body around the axis, away from the body, each of a plurality of diverging lens covers one of the light source modules; the body is provided with a plurality of lens slots, the body is made of metal, the plurality of lens slots are arranged around the axis, and the lens slots extend in a same direction as the axis; adjoined sides of two adjacent lens slots are integrated into an adjoined portion, and the adjoined portion comprises an outer side surface away from the axis, and a side of each lens slot away from the axis comprises a light outgoing notch, two sides of each light outgoing notch comprise shading portions, and the shading portions respectively extend from each light outgoing notch to cover the edge of an outer surface of each of the diverging lens inserted into the plurality of lens slots.

* * * * *